US006330011B1

(12) United States Patent
Taira et al.

(10) Patent No.: US 6,330,011 B1
(45) Date of Patent: Dec. 11, 2001

(54) ELECTROPHOTOGRAPHY APPARATUS AND EXPOSURE APPARATUS USING PARTICULARLY SHAPED LIGHT EMITTING ELEMENTS

(75) Inventors: Yoshihiko Taira; Youji Houki; Hirofumi Nakayasu, all of Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/280,013

(22) Filed: Mar. 29, 1999

(30) Foreign Application Priority Data

Apr. 10, 1998 (JP) ..... 10-099740

(51) Int. Cl.[7] ..... B41J 2/385; G03G 13/04
(52) U.S. Cl. ..... 347/131; 347/130; 347/138
(58) Field of Search ..... 347/119, 118, 347/130, 238, 242, 257, 138, 237, 241, 244, 117, 131; 399/299

(56) References Cited

U.S. PATENT DOCUMENTS

| | | | | |
|---|---|---|---|---|
| 4,553,148 | * | 11/1985 | Behrens et al. | 347/244 |
| 4,875,057 | * | 10/1989 | Hediger et al. | 347/242 |
| 4,928,118 | * | 5/1990 | Leksell et al. | 347/241 |
| 5,079,567 | * | 1/1992 | Beaman et al. | 347/238 X |
| 5,257,049 | * | 10/1993 | Peteghem | 347/238 |
| 5,258,629 | * | 11/1993 | Itoh et al. | 347/237 X |
| 5,262,798 | * | 11/1993 | Reinten | 347/238 X |
| 5,274,732 | * | 12/1993 | Farnand et al. | |
| 5,300,954 | * | 4/1994 | Murano et al. | 347/130 |
| 5,317,344 | * | 5/1994 | Beaman et al. | 347/237 |
| 5,481,292 | * | 1/1996 | Reinten | 347/238 |
| 5,740,493 | * | 4/1998 | Otaki et al. | 399/299 X |
| 5,861,992 | * | 1/1999 | Gelbart | 347/241 X |
| 5,946,022 | * | 8/1999 | Kamimura | 347/238 |
| 6,121,996 | * | 9/2000 | Gelbart | 347/241 |

FOREIGN PATENT DOCUMENTS

| | | | |
|---|---|---|---|
| 60-48382 | * | 3/1985 | (JP) |
| 62-136956 | | 6/1987 | (JP) |
| 64-27945 | | 1/1989 | (JP) |
| 1-165442 | * | 6/1989 | (JP) |
| 4-168067 | * | 6/1992 | (JP) |
| 11-58820 | * | 3/1999 | (JP) |

* cited by examiner

*Primary Examiner*—Susan S. Y. Lee
(74) *Attorney, Agent, or Firm*—Armstrong, Westerman, Hattori, McLeland & Naughton, LLP.

(57) ABSTRACT

An electrophotography apparatus is provided with one or a plurality of recording units which optically form a latent image on a body. Each of the recording units includes a plurality of light emitting elements having a shape which satisfies a relationship $t/y<T/Y<1$, where t indicates a width of a pixel of the latent image in a sub scanning direction, y indicates a length of the pixel in a main scanning direction, T indicates a width of a light emitting element in the sub scanning direction, and Y indicates a length of the light emitting element in the main scanning direction.

8 Claims, 9 Drawing Sheets

FIG. 8

| ITEM | | EMBODIMENT (INVENTION) | CONVENTIONAL CASE |
|---|---|---|---|
| SHAPE OF LIGHT EMITTING ELEMENT | MAIN SCAN DIRECTION | Y ≒ 23 μm | y ≒ 23 μm |
| | SUB SCAN DIRECTION | T ≒ 14 μm | t ≒ 8 μm |
| EXPOSURE BEAM DIAMETER | MAIN SCAN DIRECTION | ≒ 53 μm | ≒ 53 μm |
| | SUB SCAN DIRECTION | ≒ 44 μm | ≒ 38 μm |
| TEMPERATURE RISE DIFFERENCE DUE TO PRINTING PATTERN | | 9.9°C | 16.2°C |
| ERROR IN EXPOSURE WIDTH CAUSED BY TEMPERATURE RISE | | 30.3 μm | 48.6 μm |

FIG. 9

| ITEM | EMBODIMENT (INVENTION) | CONVENTIONAL CASE |
|---|---|---|
| TEMPERATURE RISE WHEN EMITTING LIGHT FOR 2DOTS | 2.9°C | 4.1°C |
| TEMPERATURE RISE WHIEN EMITTING LIGHT FOR ALL DOTS | 12.8°C | 20.3°C |
| LIGHT EMITTING LIGHT FOR ALL DOTS | 8.7 μm | 12.3 μm |
| LIGHT EMITTING WIDTH WHEN EMITTING LIGHT FOR ALL DOTS | 38.4 μm | 80.9 μm |

ELECTROPHOTOGRAPHY APPARATUS AND EXPOSURE APPARATUS USING PARTICULARLY SHAPED LIGHT EMITTING ELEMENTS

BACKGROUND OF THE INVENTION

1. Field of the Invention

The present invention generally relates to electrophotography apparatuses and exposure apparatuses, and more particularly to an electrophotography apparatus and an exposure apparatus which forms a latent image using an optical system of a LED head.

2. Description of the Related Art

Conventionally, there is an electrophotography apparatus which is provided with a LED head having a plurality of fine LED elements arranged in a main scanning direction. An image is formed on a recording medium such as paper by exposing a latent image on a drum using the LED head, developing the latent image, and transferring the developed image on the recording medium. The LED head of this electrophotography apparatus is designed so that a moving quantity amounting to 1 line in a sub scanning direction is equal to a width of the LED head in the sub scanning direction, and so that a scan in the sub scanning direction can be made at a finer pitch than in the main scanning direction. The sub scanning direction corresponds to a moving direction of the recording medium. The LED head prints the image on the recording according to the tone production method by density of each LED element, by making the halftone representation in the form of an area ratio representation. More particularly, the size of 1 pixel is divided into N elements in the sub scanning direction, and the gradation representation is made by the area ratio of the elements by successively scanning at the moving quantity corresponding to each of the N elements when making the exposure.

When a current is supplied to the LED head of the electrophotography apparatus to emit light, heat is generated in the LED head and the exposure width of the LED head changes. More particularly, the entire length of the LED head in the main scanning direction changes due to the generated heat. For this reason, in order to improve the resolving power and to improve the degree of the gradation representation, it is necessary to reduce the width of each LED element of the LED head in the sub scanning direction and to reduce the length of each LED element of the LED head in the main scanning direction. However, when the width and length of each LED element of the LED head are reduced, the light emitting area becomes small and the quantity of light decreases. In order to increase the quantity of light and to secure approximately the same exposure, it is necessary to supply more current to each LED element of the LED head. But when more current is supplied to each LED element of the LED head, the amount of heat generated from each LED element increases, thereby causing an error among the individual LED heads. The error in the pixel positions of the image exceeds a tolerable value when such an error is introduced among the individual LED heads, and an image having a high quality cannot be printed by use of such LED heads. As a result, it is not possible to make each LED element of the LED head small to the extreme.

Accordingly, in the electrophotography apparatus which prints a full color image using LED heads for the exposure of each of the colors, it is desirable to realize an optimum design wherein the amount of heat generated by the LED elements of the LED heads is small and the error among the printing positions of the images of each of the colors is eliminated, in a state where the resolving power of the images of each of the colors and the degree of the gradation representation are both improved. A contour of an object in the image should match among the images of each of the colors, but if the error exists among the printing positions of the images of each of the colors, the original color of the final image cannot be reproduced at the portion where the contours of the images of each of the colors do not match, thereby causing a color error or an unwanted color overlap. In this specification, such an error will be referred to as a registration error.

The following limitations exist in the case of the electrophotography apparatus which uses the LED heads and employs the tandem system.

(1) An error is introduced among the exposure widths of the LED heads, and thus, an error is generated in the printing positions of the LED heads in the main scanning direction. Hence, in order to suppress this error, It is necessary to reduce the amount of heat generated by the LED elements of the LED heads so as to become less than or equal to a tolerable value. For example, the amount of heat generated by the LED elements of the LED heads must be reduced so that the error among the entire lengths of the LED heads is less than or equal to a distance amounting to ½ pixel. On the other hand, the amount of heat generated by the LED elements of the LED heads becomes larger as the width of each LED element of the LED heads becomes smaller.

(2) Even if the width of the LED element of the LED head is reduced, the exposure beam diameter cannot be reduced beyond a certain limit if the same lens is used, where the same lens is gradient index (GRIN) lens such as a SELFOC lens.

(3) The width of the LED head in the sub scanning direction must be set smaller than the length of the LED head in the main scanning direction, and the moving quantity of the LED head in the sub scanning direction must be set small, so as to make the gradation representation by the area ratio representation.

On the other hand, the LED head is mounted on a frame, and radiator fins are secured on the frame by screws, so as to radiate the heat of the frame. But depending on the manner in which the radiator fins are secured on the frame by the screws or, when a central portion of the frame is pushed and bent for some reason such as a force applied on the central portion of the frame by a person mounting the LED head in the electrophotography apparatus, the relative positions of the radiator fins and the frame changes due to forced slipping of the radiator fins relative to the frame. When the relative positions of the radiator fins and the frame change, the relative positions will not return to the original positions because the radiator fins are secured on the frame by the screws. As a result, the frame on which the LED head is mounted remains in a state where the frame is bent by approximately several tens of $\mu$m to one hundred and several tens of $\mu$m. When the frame remains in such a bent state, there is a problem in that a defocusing (or out-of focus) state is generated.

SUMMARY OF THE INVENTION

Accordingly, it is a general object of the present invention to provide a novel and useful electrophotography apparatus and exposure apparatus, in which the problems described above are eliminated.

Another and more specific object of the present invention is to provide an electrophotography apparatus and an exposure apparatus, which can reduce a registration error of the LED head and improve the resolving power, thereby making the apparatuses suited for use in color printing.

Still another object of the present invention is to provide an electrophotography apparatus comprising one or a plurality of recording units which optically form a latent image on a body, and each of the recording units comprises a plurality of light emitting elements having a shape which satisfies a relationship $t/y<T/Y<1$, where t indicates a width of a pixel of the latent image in a sub scanning direction, y indicates a length of the pixel in a main scanning direction, T indicates a width of a light emitting element in the sub scanning direction, and Y indicates a length of the light emitting element in the main scanning direction. According to the electrophotography apparatus of the present invention, it is possible to improve the light emitting efficiency of the light emitting elements and to suppress the heat generated from the light emitting elements, so that a registration error among the recording units is reduced, and the resolving power and the gradation representation are optimized.

A further object of the present invention is to provide an exposure apparatus comprising a head having a plurality of light emitting elements arranged in a main scanning direction, a case on which the head is mounted, a frame having a first side, and a second side on which the case is mounted, and a radiator member mounted on the first side of the frame, where the radiator member is secured on the frame by an adhesive agent interposed therebetween. According to the exposure apparatus of the present invention, it is possible to prevent the radiator member and the frame from being displaced relative to each other due to an external force applied thereon, for example, so that a defocusing state is positively prevented.

Other objects and further features of the present invention will be apparent from the following detailed description when read in conjunction with the accompanying drawings.

BRIEF DESCRIPTION OF THE DRAWINGS

FIG. 8 is a diagram for explaining the performance of the embodiment of the electrophotograph apparatus in relation to a conventional electrophotography apparatus;

FIG. 9 is a diagram for explaining parameters used in the embodiment of the electrophotography apparatus and the conventional electrophotography apparatus described with reference to FIG. 8.

DESCRIPTION OF THE PREFERRED EMBODIMENTS

Figure 1B:
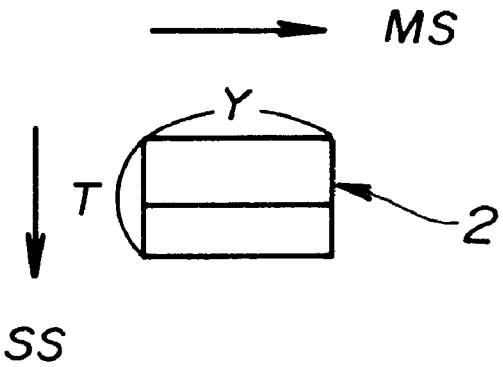
FIGS. 1A and 1B respectively are diagrams for explaining the operating principle of the present invention.
Figure 1A:
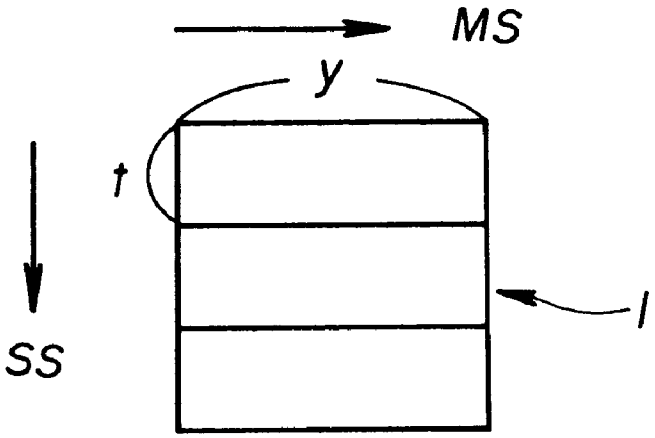
Figures 2A, 2B:
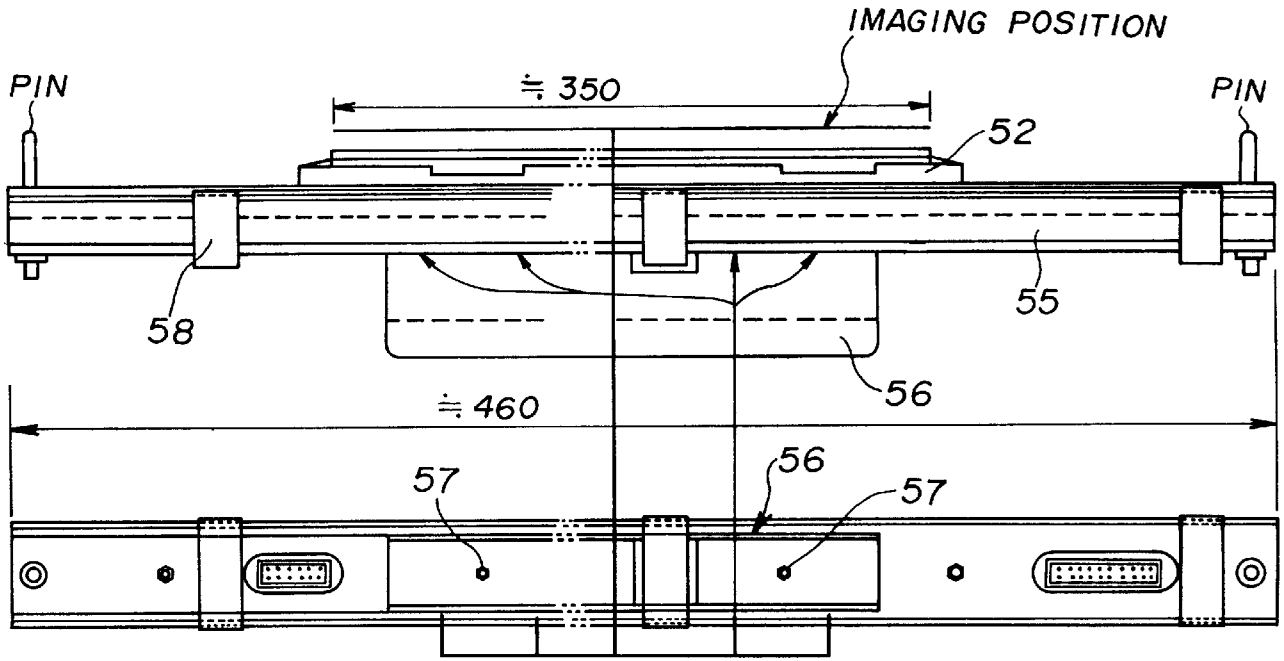
FIGS. 2A and 2B respectively are a side view and a bottom view showing a light emitting element array.

First, a description will be given of the operating principle of the present invention, by referring to FIGS. 1A, 1B, 2A and 2B. FIG. 1A is a diagram showing a pixel, and FIG. 1B is a diagram showing a light emitting element. FIGS. 2A and 2B respectively are a side view and a bottom view showing a light emitting element array.

A pixel 1 shown in FIG. 1A has a size of t x y in arbitrary units. This pixel 1 is exposed on a photoconductive body (not shown), developed, and transferred onto a recording medium such as paper. In FIG. 1A, MS indicates a main scanning direction, and SS indicates a sub scanning direction. The recording medium is transported in this sub scanning direction SS.

On the other hand, a light emitting element 2 shown in FIG. 1B has a size of T×Y in arbitrary units. In FIG. 1B. MS and SS respectively indicate the main scanning direction and the sub scanning direction, as in FIG. 1A.

In FIGS. 2A and 2B, a plurality of light emitting elements 2 are fixed on a case 52, and the case 52 is fixed on a frame 55. Cooling fins 56 are fixed on the frame 55 by fixing screws 57 and an adhesive agent 300 applied on the entire mounting surface of the cooling fins 56, as indicated by arrows in FIGS. 2A and 2B. The light emitting element array shown in FIGS. 2A and 2B will be described in more detail later in the specification in conjunction with the embodiment.

In the present invention, an electrophotography apparatus employing the tandem system uses a plurality of heads. Each of the heads includes a plurality of light emitting elements 2. Each of the light emitting elements 2 of the head has a shape satisfying $t/y<T/Y<1$, where t indicates the width of the pixel 1 in the sub scanning direction SS, y indicates the length of the pixel 1 in the main scanning direction MS, T indicates the width of the light emitting element 2 in the sub scanning direction SS, and Y indicates the length of the light emitting element 2 in the main scanning direction MS. This shape of the light emitting element 2 suppresses the amount of heat generated by the light emitting element 2, and suppresses a registration error among the heads, thereby optimizing the resolution of the printed image.

In addition, when the width T of the light emitting element 2 in the sub scanning direction SS is smaller than the width t of the pixel 1 in the sub scanning direction SS, it is possible to increase the light emitting time so as to prevent a dropout of the printed pixel.

On the other hand, in the present invention, an exposure apparatus employing the tandem system uses a plurality of heads. Each of the heads includes a predetermined number of light emitting element blocks arranged in the main scanning direction MS, where each light emitting element block includes a plurality of light emitting elements 2. The head is fixed on the case 52, and the case 52 is fixed on the frame 55. The cooling fins 56 are fixed on the side of the frame 55 opposite to the side provided with the case 52. The cooling fins 56 are fixed on the frame 55 by the fixing screws 57 and the adhesive agent 300 which is applied on the entire mounting surface of the cooling fins 56, so as to prevent the cooling fins 56 and the frame 55 slipping relative to each other. In addition, even if the frame 55 is bent for some reason, the fixing screws 57 and the adhesive agent 300 positively prevent the slipping described above, so that the problem of defocusing (out-of focus) state will not occur as in the conventional case.

Therefore, according to the present invention, it is possible to improve the light emitting efficiency and to suppress the amount of heat generated by the light emitting elements 2, by making each light emitting element 2 of the head and each pixel satisfy the relationship $T/Y>t/y$, so that the error in the printing positions among the heads is reduced and both the resolving power and the gradation representation are optimized. Furthermore, according to the present invention, it is possible to prevent the defocusing state from occurring when the cooling fins 56 are fixed on the frame 55 which is mounted with the light emitting elements 2.

Next, a description will be given of an embodiment of the electrophotography apparatus according to the present invention, by referring to FIGS. 1A through 10. This embodiment of the electrophotography apparatus uses an embodiment of the exposure apparatus according to the present invention.

In a case where the pixel 1 shown in FIG. 1A is arranged at 1800 dpi in the sub scanning direction SS and at 600 dpi in the main scanning direction MS, for example, the width t in the sub scanning direction SS is t=25.4 (mm)/1800≈14 μm. In addition, the length y in the main scanning direction MS is y=25.4 (mm)/600 ≈42 μm.

In this embodiment, the above described width t and the length y of the pixel 1, the width T of the light emitting element 2 in the sub scanning direction SS shown in FIG. 1B, and the length Y of the light emitting element 2 in the main scanning direction MS satisfy the following relationship (1).

$$t/y<T/Y<1 \quad (1)$$

Since T/y<1 in the relationship (1) described above, it means that the width T of the light emitting element 2 in the sub scanning direction SS is smaller than the length Y of the light emitting element 2 in the main scanning direction MS. By setting the width T and the length Y of the light emitting element 2 in this manner, it is possible to realize the performance which will be described later in conjunction with FIGS. 7A through 7D. More particularly, it is possible to (i) reduce the amount of heat generated by the light emitting element 2 and accordingly reduce the registration error among the heads, (ii) obtain a line width having a predetermined width, and (iii) appropriately represent the halftone by the area ratio by dividing the pixel size in the sub scanning direction SS and scanning depending on the divisions.

In a case where the resolving power of the pixel 1 in the sub scanning direction SS is 1800 dpi and the resolving power of the pixel 1 in the main scanning direction MS is 600 dpi as described above, the following relationships stand.

$y$:600 dpi ($y$=42 μm)

$t$:1800 dpi ($t$=12 μm)

$t/y=1/3$ $Y=23$ μm $T=14$ μm $T/Y=1/1.6$

The present inventors conducted experiments by setting the width T of the light emitting element 2 in the sub scanning direction SS and the length Y of the light emitting element 2 in the main scanning direction MS as described above. As a result of the experiments, it was found that the performance which will be described later in conjunction with FIGS. 8 and 9 are obtainable. More particularly, it was found that the apparatus according to the present invention can considerably suppress the temperature rise and eliminate the registration error among the heads.

Figure 3:
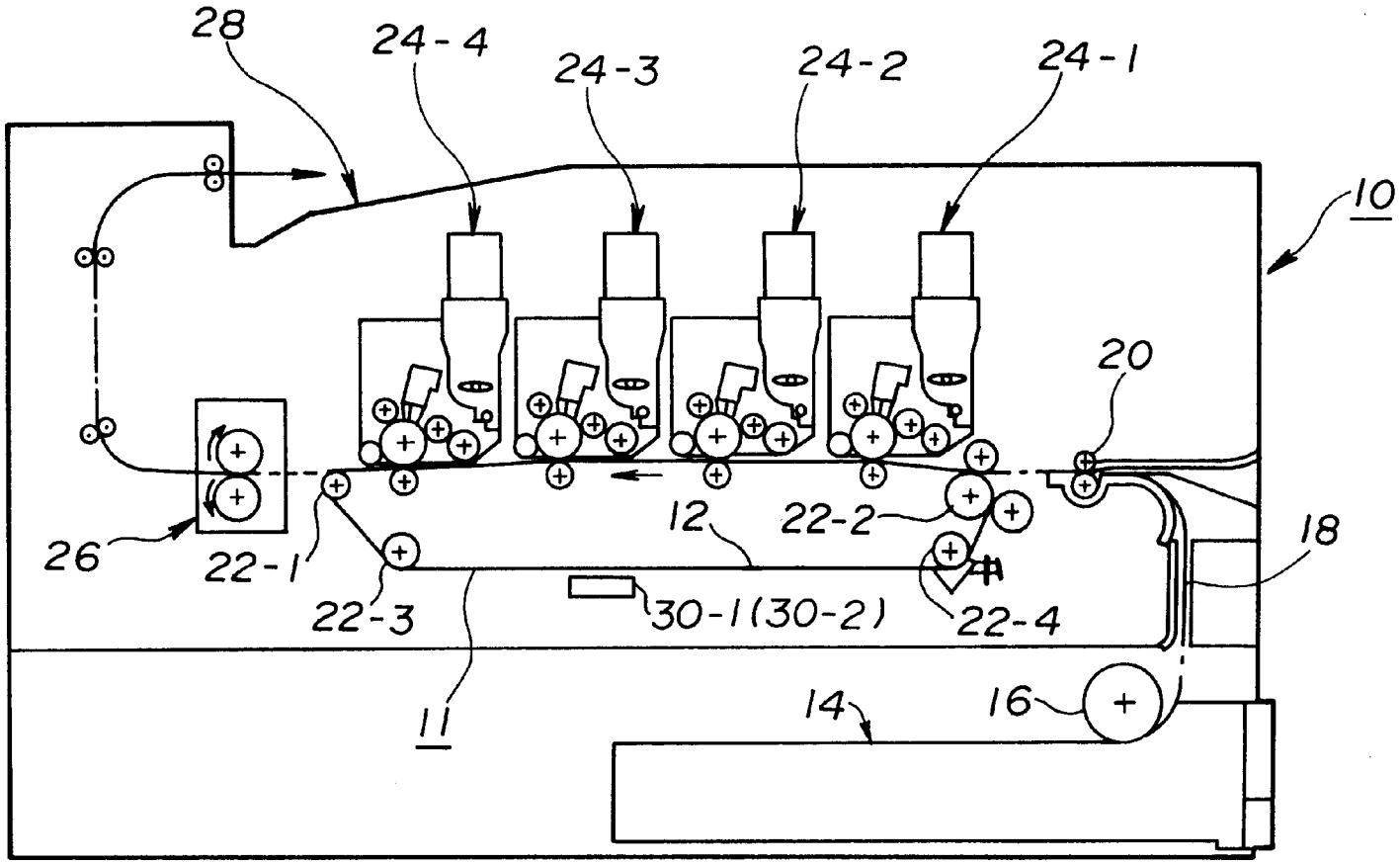
FIG. 3 is a diagram showing the general construction of an embodiment of an electrophotography apparatus according to the present invent

FIG. 3 is a diagram showing the general construction of this embodiment of the electrophotography apparatus. A transport belt unit 11 for transporting the recording medium such as paper is provided within a main apparatus body 10. The transport belt unit 11 includes a rotatable endless belt 12 which is made of a dielectric material having a light transmitting characteristic, such as an appropriate synthetic resin material. The endless belt 12 is provided around four rollers 22-1, 22-2, 22-3 and 22-4. The transport belt unit 11 is detachably provided with respect to the main apparatus body 10.

The roller 22-1 functions as a driving roller which is driven by a known driving mechanism (not shown). The driving roller 22-1 is driven by the driving mechanism and drives the endless belt 12 in a counterclockwise direction indicated by an arrow in FIG. 3, so that the endless belt 12 is moves at a constant speed. On the other hand, the roller 22-2 functions both as a freely rotatable roller and a charging roller which applies a charge on the endless belt 12.

The rollers 22-3 and 22-4 both function as guide rollers. The guide roller 22-3 is disposed in a vicinity of the driving roller 22-1, and the guide roller 22-4 is disposed in a vicinity of the charging roller 22-2. An upper part of the endless belt 12 between the charging roller 22-2 and the driving roller 22-1 forms a medium transporting path for transporting the recording medium. The recording mediums are stacked in a hopper 14, and are successively fed one by one from the top recording medium by a pickup roller 16. The recording medium which is fed by the pickup roller 16 passes through a medium guide passage 18, and is supplied by a pair of medium supply rollers 20 to the medium transporting path of the endless belt 12 from the side of the charging roller 22-2. The recording medium after passing through the medium transporting path is ejected via the driving roller 22-1.

The endless belt 12 is charged by the charging roller 22-2. For this reason, when the recording medium is supplied to the medium transporting path via the charging roller 22-2, the recording medium is electrostatically attracted to the endless belt 12 and a positional deviation of the recording medium during the transport is prevented. However, when ejecting the recording medium via the driving roller 22-1, it is possible to easily separate the recording medium from the endless belt 12.

Four electrostatic recording units 24-1, 24-2, 24-3 and 24-4 are provided within the main apparatus body 10. The recording unit 24-1 is provided to print in yellow (Y), and the recording unit 24-2 is provided to print in magenta (M). The recording unit 24-3 is provided to print in cyan (C), and the recording unit 24-4 is provided to print in black (K). The Y, M, C and K recording units 24-1, 24-2, 24-3 and 24-4 successively print images on the recording medium which is transported in the medium transport path of the endless belt 12 between the charging roller 22-2 and the driving roller 22-1. In other words, the tandem system is employed such that the Y. M, C and K recording units 24-1, 24-2, 24-3 and 24-4 are arranged in series from the upstream side to the downstream side along the transport direction of the recording medium.

The Y, M, C, and K recording units 24-1, 24-2, 24-3 and 24-4 have the same construction, except that the Y recording unit 24-1 uses a yellow (Y) toner component, the M recording unit 24-2 uses a magenta (M) toner component, the C recording unit 24-3 uses a cyan (C) toner component, and the B recording unit 24-4 uses a black (K) toner component.

Accordingly, yellow (Y), magenta (M), cyan (C) and black (K) toner images are successively formed by the Y, M, C and K recording units 24-1, 24-2, 24-3 and 24-4 on the recording medium which is transported in the medium transport path of the endless belt 12, and a full color image is formed by the overlapping Y, M, C and K toner images.

Figure 4:
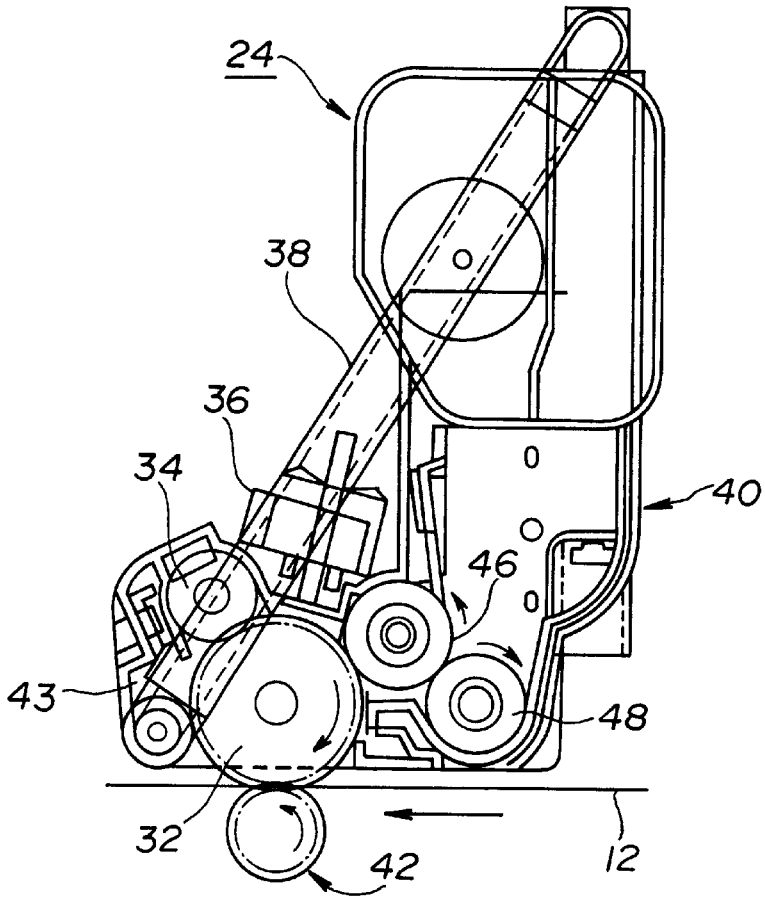
FIG. 4 is a side view showing a recording unit having the light emitting element array.

The recording unit having a light emitting element array will now be described with reference to FIG. 4. FIG. 4 is a side view showing a recording unit 24 which corresponds to any one of the Y, M, C and K recording units 24-1, 24-2, 24-3 and 24-4.

As shown in FIG. 4, the recording unit 24 is provided with a photoconductive body 32 which is rotated clockwise when carrying out a recording operation. A precharger 34 is arranged above the photoconductive body 32, and the outer peripheral surface of the photoconductive body 32 is uniformly charged by the precharger 32. For example, the precharger 32 is formed by a corona charger, a scorotron charger, a brush charger or a roller charger.

A light emitting element array 36 is arranged to confront a charged region of the photoconductive body 32. This light emitting element array 36 functions as an optical write unit, and writes a charged latent image on the photoconductive body 32 by emitting a light which scans the photoconductive body 32. In other words, the light emitting elements 2 which are arranged in the main scanning direction MS in the light emitting element array 36 are driven based on the gradation values of the image data (dot data) which are developed from the image data which is provided as printing information from a computer, a word processor or the like. Hence, the electrostatic latent image is written as the dot image.

In this embodiment, a light emitting diode (LED) is used as the light emitting element 2, and thus, a LED array is used as the light emitting element array 36.

The electrostatic image written on the photoconductive body 32 is electrostatically developed into a charged toner image of a predetermined color by a developing unit 40 which is arranged above the photoconductive body 32. The charged toner image on the photoconductive body 32 is electrostatically transferred onto the recording medium by a transfer roller 42 which is positioned below the photoconductive body 32.

In other words, the transfer roller 42 confronts the photoconductive body 32 via the endless belt 12, with a small gap between the photoconductive body 32. The transfer roller 42 applies on the recording medium which is transported by the endless belt 12 a charge of a polarity opposite to the polarity of the charged toner image formed on the photoconductive body 32. Hence, the charged toner image on the photoconductive body 32 is electrostatically transferred onto the recording medium.

After the transfer process described above, residual toner not transferred onto the recording medium remains adhered on the surface of the photoconductive body 32. The residual toner is removed by a toner cleaning unit 43 which is provided on the downstream side of the medium transport path with respect to the photoconductive body 32. The removed residual toner is returned to the developing unit 40 by a screw conveyor 38, and is reused as the developing toner.

When the recording medium passes through the medium transport path on the endless belt 12 between the charging roller 22-2 and the driving roller 22-1 in FIG. 3, the full color image is formed on the recording medium by the Y, M, C and K toner images which are successively formed by the Y, M, C and K recording units 24-1, 24-2, 24-3 and 24-4 and overlap on the recording medium. The recording medium having the full color image formed thereon is supplied from the driving roller 22-1 towards a heat roller type thermal fixing unit 26 which thermally fixes the full color image on the recording medium. After the thermal fixing, the recording medium is guided by guide rollers and is stacked on a stacker 28 which is provided at a top part of the main apparatus body 10.

A pair of sensors 30-1 and 30-2 are arranged under the lower part of the endless belt 12 in a direction perpendicular to the moving direction of the endless belt 12. Only the sensor 30-1 is visible in FIG. 3. The sensors 30-1 and 30-2 are used to optically read a resist mark which is printed on the endless belt 12 for the purpose of detecting the error in the printing position.

Figure 5:
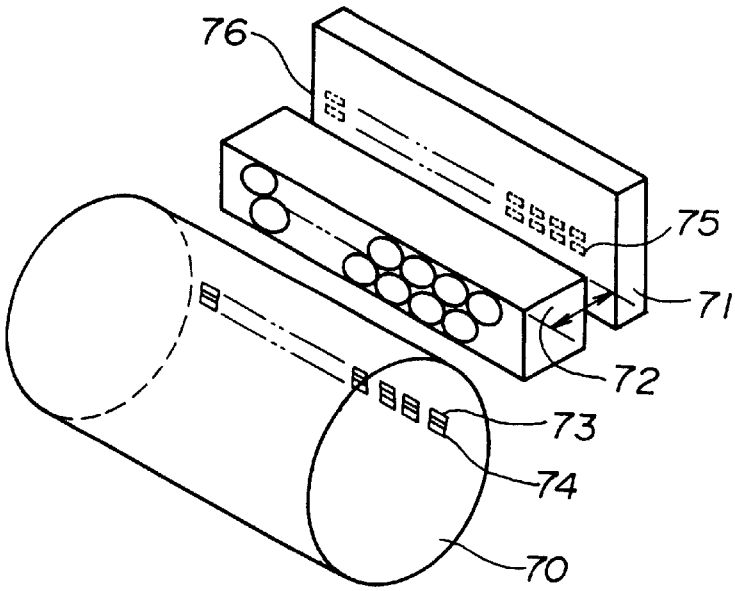
FIG. 5 is a perspective view showing a photoconductive drum and parts associated therewith.

FIG. 5 is a perspective view showing a photoconductive drum and parts associated therewith.

More particularly, FIG. 5 shows a photoconductive drum 70 which corresponds to the photoconductive body 32, together with a LED array 71 which corresponds to the light emitting element array 36, and an imaging means 72. It is assumed for the sake of convenience that the halftone is printed by dividing the pixel in N divisions in the sub scanning direction SS.

In FIG. 5, the LED array 71 emits a light towards the photoconductive drum 70, and the imaging means 72 images the light from the LED array 71 on the photoconductive drum 70. Each LED 75 of the LED array 71 emits the light to expose the photoconductive drum 70 in correspondence with each pixel 73 of the image which is to be recorded. This pixel 73 corresponds to the pixel 1 described above. A width of each pixel 73 is 1/N a width 76 of the LED 75 of the LED array 71. The pixel 73 which is to be recorded is equally divided into N divisions in the moving direction of the photoconductive drum 70, that is, in the sub scanning direction SS, so that the pixel 73 is made up of N dots 74. Among the N dots 74 making up one pixel 73, a predetermined number of dots 74 is exposed depending on the gradation with which this one pixel 73 is to be printed, thereby realizing the halftone representation of the pixel 73. Therefore, the halftone can be exposed as a latent image on the photoconductive drum 70 by the ratio of areas of the exposed dots 74 and the non-exposed dots 74.

Figure 6:
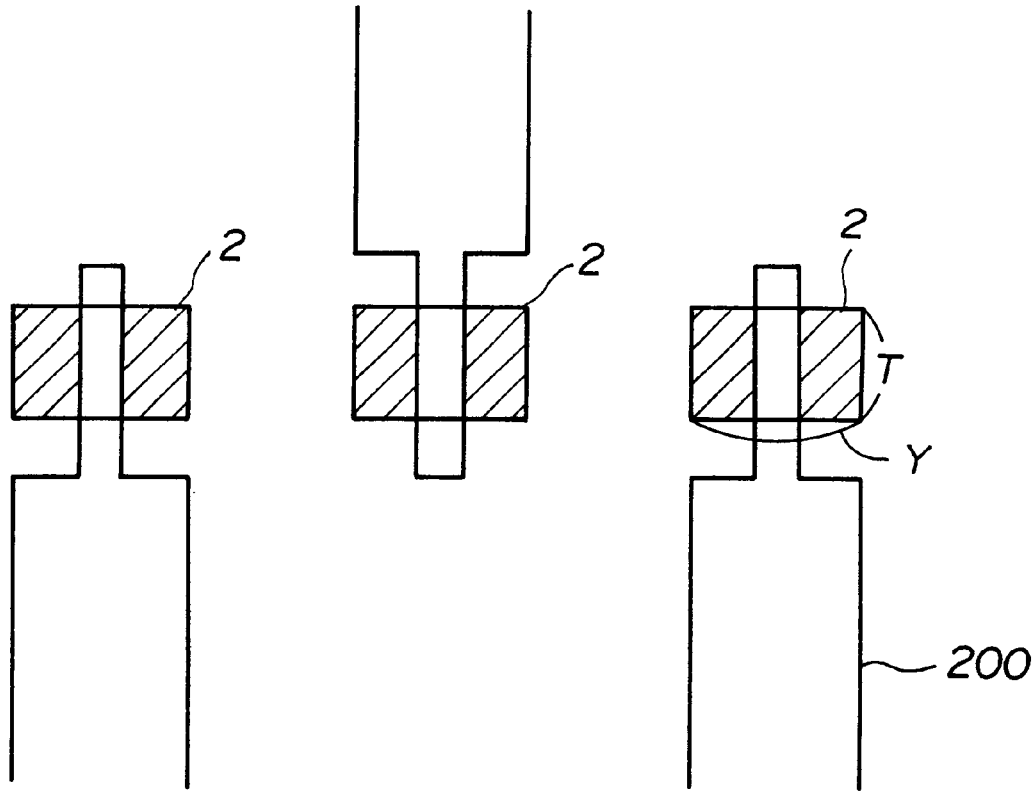
FIG. 6 is a diagram showing light emitting elements.

FIG. 6 is a diagram showing the light emitting elements. In this particular case shown in FIG. 6, the light emitting elements 2 described above are formed on a large scale integrated (LSI) circuit. In FIG. 6, a reference numeral 200 denotes an electrode. For example, 128 light emitting elements 2 are arranged in the horizontal direction in FIG. 6 to form one block, and 60 of such blocks are fixed on the case 52 shown in FIG. 2A by the adhesive agent 300, so as to form the light emitting element array 36 which is made up of a total of 128×60 light emitting elements 2. As described above in conjunction with FIG. 1B, each light emitting element 2 has the width T in the sub scanning direction SS and the length Y in the main scanning direction MS. The electrode 200 supplies a current to the corresponding light emitting element 2 depending on the printing information (dot data) so as to make the corresponding light emitting element 2 emit a light. When the width T and the length Y of the light emitting element 2 are set to the relationships described above, it is possible to eliminate the registration error among the heads as compared to the conventional case, as will be described later in conjunction with FIGS. 8 and 9.

FIGS. 7A through 7D respectively are diagrams for explaining characteristics of this embodiment of the electrophotography apparatus. FIGS. 7A through 7D are used to explain the improvement over the conventional case when the image is printed by this embodiment of the electrophotography apparatus using the light emitting element 2 shown In FIG. 1B.

Figure 7A:
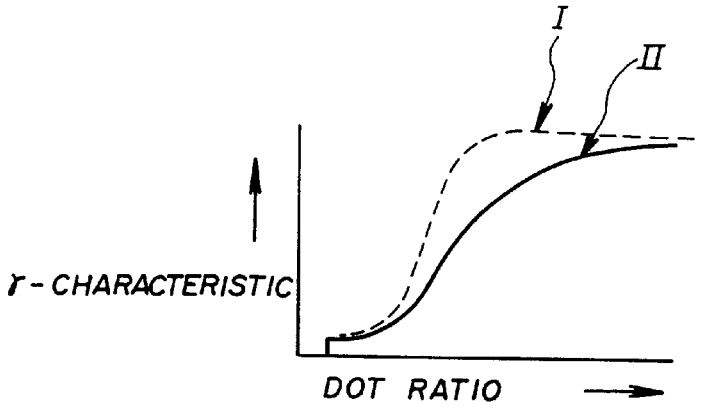
FIGS. 7A through 7D respectively are diagrams for explaining characteristics of the embodiment of the electrophotography apparatus.

FIG. 7A Is a diagram showing an improved γ-characteristic with respect to a dot ratio. When the area of the light emitting element 2 is set large, the characteristic curve changes as indicated by a dotted line I. On the other hand, the characteristic curve changes as indicated by a solid line II when the area of the light emitting element 2 is set small. Hence, an optimum characteristic curve can be determined by obtaining various characteristic curves through experiments. When determining the optimum characteristic curve, a desirable range is obtained by totally taking into consideration the characteristics described hereunder with reference to FIGS. 7B through 7D.

Figure 7B:
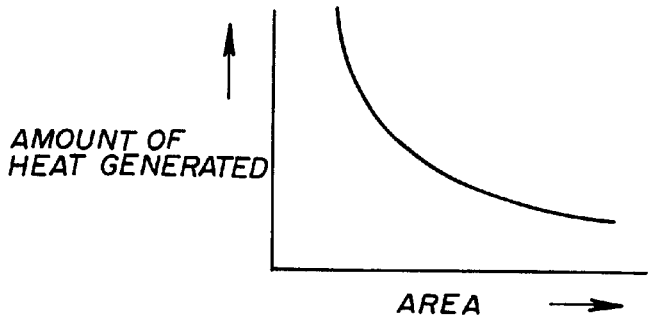

FIG. 7B is a diagram showing an improved amount of heat generated by the light emitting element 2 with respect to an area. As shown in FIG. 7B, the amount of heat generated becomes large when the area is set small. Hence, an optimum characteristic curve can be determined by obtaining various characteristic curves through experiments by gradually increasing the area of the light emitting element 2. When determining the optimum characteristic curve, the area is gradually set large by totally taking into consideration characteristics described with reference to FIGS. 7A, 7C and 7D, so as to reduce the registration error among the heads, that is, among the recording units 24-1 through 24-4 corresponding to the different colors Y, M, C and K, which will be described with reference to FIG. 7C.

Figure 7C:
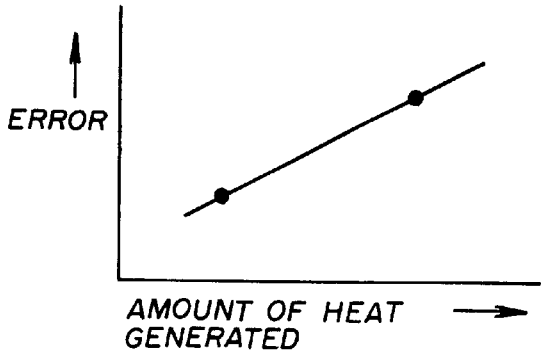

FIG. 7C is a diagram showing an improved registration error among the four recording units 24-1 through 24-4 with respect to the amount of heat generated by the light emitting element 2. When printing the full color image using the colors Y, M, C and K as described above, this registration error among the Y, M, C and K recording units 24-1, 24-2, 24-3 and 24-4 corresponds to the error in the color among the colors Y, M, C and K. The registration error increases as the amount of heat generated by the light emitting element 2 increases. Hence, an optimum characteristic curve can be determined by obtaining various characteristic curves through experiments by gradually reducing the amount of heat generated by the light emitting element 2. When determining the optimum characteristic curve, the amount of heat generated by the light emitting element 2 is gradually set small by totally taking into consideration characteristics described with reference to FIGS. 7A, 7B and 7D, so that the registration error among the recording units 24-1 through 24-4 becomes less than or equal to a tolerable value.

Figure 7D:
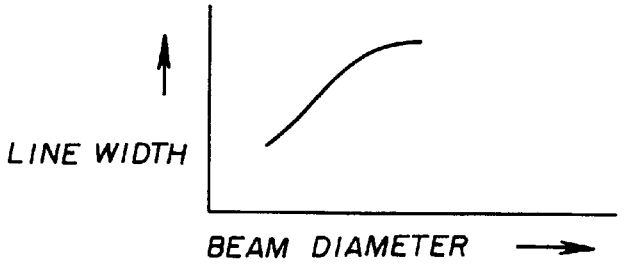

FIG. 7D is a diagram showing an improved line width with respect to a beam diameter which is formed by the light emitting element 2. As shown in FIG. 7D, the line width increases when the beam diameter increases. Hence, an optimum characteristic curve can be determined by obtaining various characteristic curves for the beam diameter through experiments so that the line width becomes less than or equal to the resolving power. When determining the optimum characteristic curve, the beam diameter of the light emitting element 2 (that is, the size of the light emitting element 2) is gradually set small by totally taking into consideration characteristics described with reference to FIGS. 7A, 7B and 7C.

Therefore, the characteristics shown in FIGS. 7A through 7D are optimized by mutually taking these characteristics into consideration and so as to satisfy the relationship (1) described above.

FIG. 8 is a diagram for explaining the performance of this embodiment of the electrophotography apparatus in relation to a conventional electrophotography apparatus, and FIG. 9 is a diagram for explaining parameters used in this embodiment of the electrophotography apparatus and the conventional electrophotography apparatus described with reference to FIG. 8. The data shown in FIGS. 8 and 9 were obtained through experiments conducted by the present inventors.

In FIG. 8, the following performance is achieved in this embodiment in comparison with the conventional case.

1. Shape of Light Emitting Element:

1.a. Embodiment:

In this embodiment, the width T in the sub scanning direction SS and the length Y in the main scanning direction MS of the light emitting element 2 respectively are set to $Y \approx 23$ μm and $T \approx 14$ μm, and the relationship (1) becomes $T/Y=14/23=1/1.64$.

1.b. Conventional case:

On the other hand, in the conventional case, the width t in the sub scanning direction SS and the length y in the main scanning direction MS of the light emitting element respectively are set to $y \approx 23$ μm and $t \approx 8$ μm, and the relationship (1) becomes $t/y=8/23=1/2.85$.

2. Exposure Beam Diameter:

2.a. Embodiment:

In this embodiment, the beam has a length of approximately 53 μm in the main scanning direction MS and a width of approximately 44 μm in the sub scanning direction SS.

2.b. Conventional Case:

On the other hand, in the conventional case, the beam has a length of approximately 53 μm in the main scanning direction MS and a width of approximately 38 μm in the sub scanning direction SS. In other words, the width of the beam is 86% of that of the embodiment and is considerably smaller in the conventional case.

3. Temperature Rise Difference Due To Printing Pattern:

3.a. Embodiment:

In this embodiment, the temperature rise difference due to the printing pattern is 9.9° C.

3.b. Conventional Case:

On the other hand, in the conventional case, the temperature rise difference due to the printing pattern is 16.2° C. which is considerably large compared to that of the embodiment.

4. Error in Exposure Width (Registration Error) Caused By Temperature Rise:

4.a. In this embodiment, the error in the exposure width is 30.3 μm.

4.b. On the other hand, in the conventional case, the error in the exposure width is 48.5 μm which is 160% that of the embodiment. In other words, the error in the exposure width, that is, the registration error among the recording units, is extremely large compared to that of this embodiment.

Therefore, according to this embodiment, it is only necessary to increase the beam diameter by 14% in order to avoid 60% of the temperature rise. By satisfying the relationship (1), the beam diameter slightly increases but the effect of reducing the temperature rise difference is far greater, thereby making it possible to greatly reduce the registration error among the recording units 24-1 through 24-4.

In FIG. 9. the following parameters are obtained in this embodiment in relation to the conventional case.

1] Temperature Rise When Emitting Light For 2 Dots:

1]-a. Embodiment:

In this embodiment, the temperature rise when emitting the light for two dots is 2.9° C.

1]-b. Conventional Case:

On the other hand, in the conventional case, the temperature rise when emitting the light for two dots is 4.1° C. This means that the embodiment can avoid a temperature rise amounting to 1.2° C. as compared to the conventional case.

2] Temperature Rise When Emitting Light For All Dots:

2]-a. Embodiment:

In this embodiment, the temperature rise when emitting the light from all of the light emitting elements 2, that is, emitting the light with respect to all of the dots, is 12.8° C.

2]-b. Conventional case:

On the other hand, in the conventional case, the temperature rise when emitting the light from all of the light emitting elements, that is, emitting the light with respect to all of the dots, is 20.3° C. This means that the embodiment can avoid a temperature rise amounting to 7.5° C. as compared to the conventional case.

3] Light Emitting Width When Emitting Light For 2 Dots:

3]-a. Embodiment:

In this embodiment, the light emitting width when emitting the light for two dots is 8.7 μm.

3]-b. Conventional Case:

On the other hand, in the conventional case, the light emitting width when emitting the light for two dots is 12.3 μm. This means that the embodiment can greatly reduce the light emitting width as compared to the conventional case.

4] Light Emitting Width When Emitting Light For All Dots:

4]-a. Embodiment:

In this embodiment, the light emitting width when emitting the light for all of the dots is 38.4 μm.

4]-b. Conventional Case:

On the other hand, in the conventional case, the light emitting width when emitting the light for all of the dots is 60.9 μm. This means that the embodiment can greatly reduce the light emitting width as compared to the conventional case.

In a case where the light emitting element array 36 is designed so that measures are taken against thermal expansion, the coefficient of linear thermal expansion of the light emitting element array 36 or the LED array 71 is 3.0 μm/° C., for example.

Therefore, by determining the shape of the light emitting element 2 as described above in conjunction with FIGS. 8 and 9 and so as to satisfy the relationship (1), this embodiment can suppress the temperature rise and reduce the registration error among the recording units 24-1 through 24-4. Of course, the number of recording units used is not limited to four.

Figure 10:
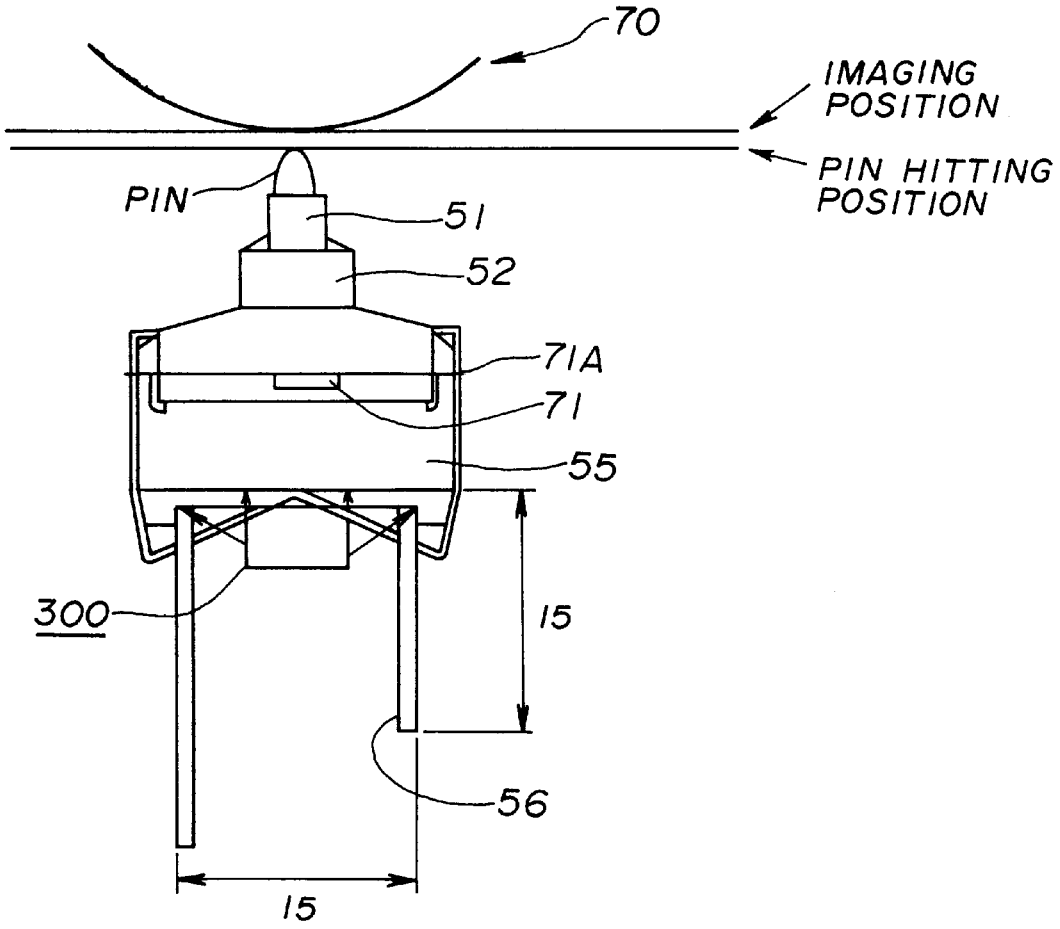
FIG. 10 is a right side view of the light emitting element array shown in FIGS. 2A and 2B.

Next, a description will be given of the light emitting element array, by referring to FIGS. 2A. 2B and 10. FIG. 10 is a right side view of the light emitting element array.

As shown in FIGS. 2A and 2B, the light emitting elements 2 are fixed to the case 52 which is made of a resin, for example. For example, 128 light emitting elements 2 form one block, and 60 such blocks are linearly arranged within the case 52 by the adhesive agent 300 as indicated by arrows in FIGS. 2A, 2B and 10. The case 52 is fixed on the frame 55 which is made of a material which is suited for radiating heat, such as a metal, and both ends of the frame 55 are fixed to the electrophotography apparatus.

The cooling fins 56 are provided to radiate the heat generated by the light emitting elements 2, so as to compensate for the heat which is not sufficiently radiated from the frame 55 itself. In this embodiment, the cooling fins 56 are made of a metal plate which is made of aluminum (Al), for example, and is bent substantially in a U-shape as shown in FIG. 10. The cooling fins 56 are fixed on the frame 55 by the fixing screws 57 and the adhesive agent 300 which is coated on the entire mounting surface of the cooling fins 56.

When a central portion of the frame 55 is pushed and bent for some reason such as a force of 5 kg, for example, applied on the central portion of the frame 55 by a person mounting the recording unit in the electrophotography apparatus, the present inventors have found through experiments that the relative positions of the radiator fins 56 and the frame 55 changes due to forced slipping of the radiator fins 56 relative to the frame 55. When the relative positions of the radiator fins 56 and the frame 55 change, the relative positions will not return to the original positions if the radiator fins 56 are secured on the frame 55 by only the fixing screws 57 and no adhesive agent is used. As a result, the frame 55 on which the recording unit is mounted remains in a state where the frame 55 is bent upwards or downwards in FIG. 10 by approximately several tens of μm to one hundred and several tens of μm. In this case, a distance between the photoconductive drum 70 and the LED 71 shown in FIG. 10 consequently changes by approximately several tens of μm to one hundred and several tens of μm. When the frame 55 remains in such this bent state, there is a problem in that a defocusing (or out-of focus) state is generated.

But when the adhesive agent 300 is applied on the entire mounting surface of the cooling fins 56 and the cooling fins 56 are secured on the frame 55 by the fixing screws 57, the frame 55 will positively return to its original state even if the central part of the frame 55 is bent, for example. As a result, this embodiment can prevent the defocusing state from being generated, even though the cooling fins 56 are mounted on the frame 55 using a relatively simple construction.

In FIGS. 2A and 10, a fixing clip 58 fixes the case 52 to the frame 55. In addition, a SELFOC lens array 51 focuses the light emitted from a light emitting surface 71A of the LED 71 within the case 52 to an imaging position on the photoconductive drum 70.

Further, the present invention is not limited to these embodiments, but various variations and modifications may be made without departing from the scope of the present invention.

What is claimed is:

1. An electrophotography apparatus comprising:

one or a plurality of recording units which optically form a latent image on a body, each of said recording units comprising a plurality of light emitting elements having a shape which satisfies a relationship $t/y<T/Y<1$, where t indicates a width of a pixel of the latent image in a sub scanning direction, y indicates a length of the pixel in a main scanning direction, T indicates a width of a light emitting element in the sub scanning direction, and Y indicates a length of the light emitting element in the main scanning direction.

2. The electrophotography apparatus as claimed in claim 1, wherein each of said recording units comprises a plurality of blocks which are arranged linearly, each of said blocks being made up of a plurality of light emitting elements which are arranged in the main scanning direction.

3. The electrophotography apparatus as claimed in claim 1, wherein said recording units form latent Images corresponding to mutually different colors.

4. The electrophotography apparatus as claimed in claim 3, wherein said recording units are arranged in series along a transport direction of a recording medium onto which developed toner images corresponding to the latent images are to be transferred.

5. The electrophotography apparatus as claimed in claim 1, wherein each of said recording units further comprises:

a case on which said light emitting elements are mounted;

a frame having a first side, and a second side on which said case is mounted; and a radiator member mounted on the first side of said frame.

6. The electrophotography apparatus as claimed in claim 5, wherein said radiator member is secured on said frame by an adhesive agent interposed therebetween.

7. An exposure apparatus for a recording unit which optically forms a latent image on a body, comprising:

a head having a plurality of light emitting elements arranged in a main scanning direction and satisfying a relationship $t/y<T/Y<1$, where t indicates a width of a pixel of the latent image in a sub scanning direction, y indicates a length of the pixel in the main scanning direction, T indicates a width of each light emitting element in the sub scanning direction, and Y indicates a length of each light emitting element in the main scanning direction;

a case on which said head is mounted;

a frame having a first side, and a second side on which said case is mounted; and a radiator member mounted on the first side of said frame, said radiator member being secured on said frame by an adhesive agent interposed therebetween.

8. The exposure apparatus as claimed in claim 7, which further comprises screws which secure the radiator member on said frame.

* * * * *